US005377992A

United States Patent [19]

Audet

[11] Patent Number: 5,377,992

[45] Date of Patent: Jan. 3, 1995

[54] METHOD OF PLAYING A BOARD GAME UTLIZING PLAYING CARDS AND TOKENS

[76] Inventor: Yvonne Audet, R.R. #2, Box 2252, Brandon, Vt. 05733

[21] Appl. No.: 270,732

[22] Filed: Jul. 5, 1994

[51] Int. Cl.[6] ..... A63F 3/06

[52] U.S. Cl. ..... 273/271; 273/269

[58] Field of Search ..... 273/271, 269, 243

[56] References Cited

U.S. PATENT DOCUMENTS 5,029,871 7/1991 Willson, Jr. et al. ..... 273/271

5,332,229 7/1994 Fielder et al. ..... 273/271

OTHER PUBLICATIONS

Cross Bingo Poker, Spencers Inc., P.O. Box 2037 Dade City, Fla. 33525, 1992.

*Primary Examiner*—Benjamin H. Layno

*Attorney, Agent, or Firm*—John J. Welch, Jr.

[57] ABSTRACT

A rectangular board same utilizing two decks of conventional playing cards, both of which decks are identical but without jokers and a plurality of distinct sets of tokens or pegs for placement upon rectangular spaces of equal area on the face of the drawing board or within holes found in the spaces and providing for shuffling, combining the decks of cards and dealing a distinct number of the cards to each player of the game and further providing that each player will in sequence, lay down a card of that player's hand, cover a rectangular space corresponding to the card lain down or lay down a red ace and cover any rectangular space or lay down a black ace and remove one of an opponent's tokens from one of the rectangular spaces, and replace it with one of his/her own, then draw a card providing that the process is repeated sequentially until a player would win the game by being the first player to cover on the game board five rectangular spaces, one then three then one to form on the board a shape in the form of a letter, Z or a reverse letter, Z and then with further play five more rectangular spaces, one then three then one to form a second shape on the board in the form of a reverse letter Z or a letter Z but such that both shapes are the opposite of the other, with play continuing if need be after all cards are drawn from the draw pile by reshuffling and combining all discards of all players to form a renewed draw pile.

2 Claims, 4 Drawing Sheets

FIG. 1
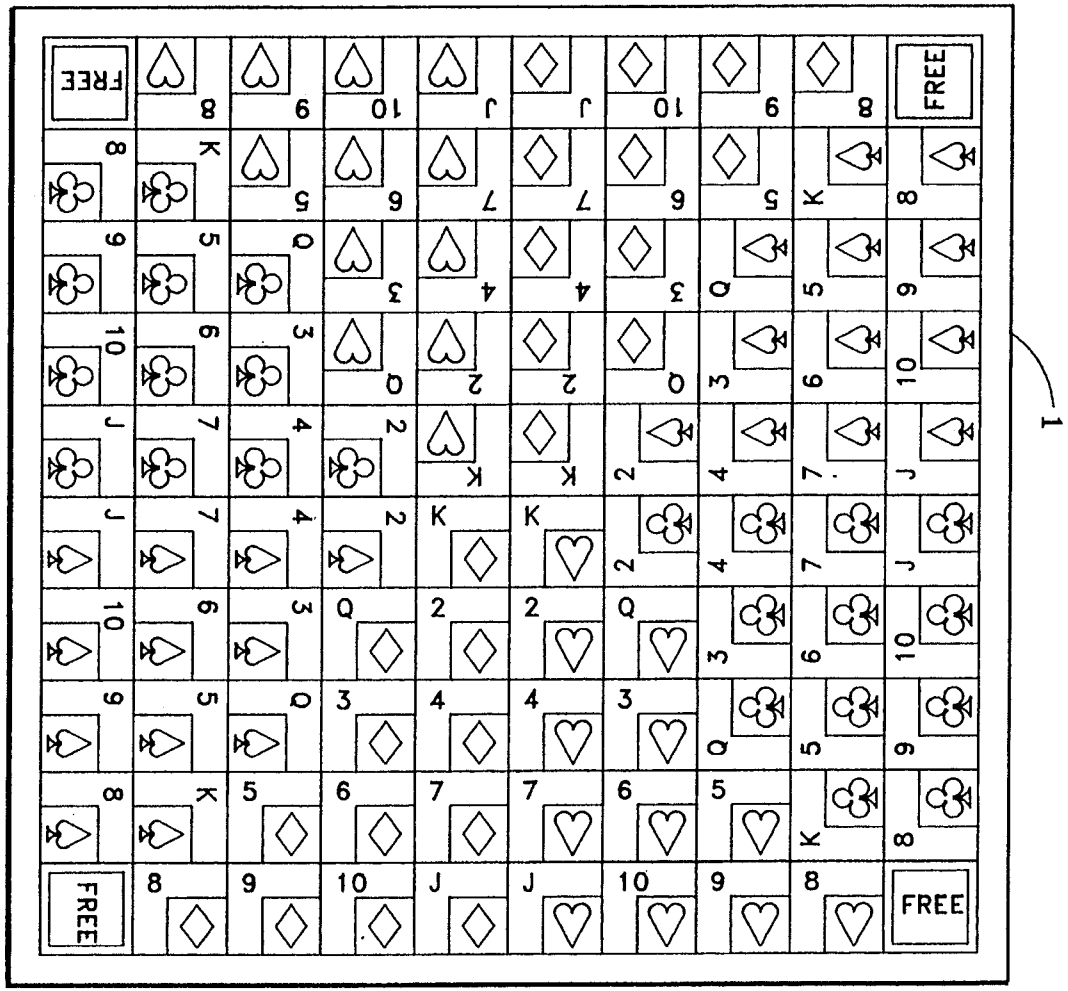
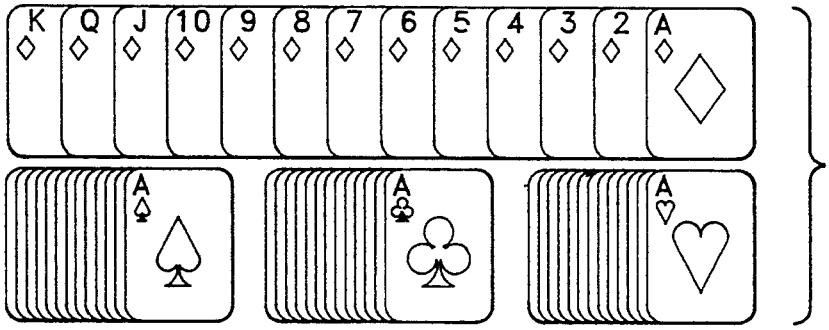
FIG. 2a
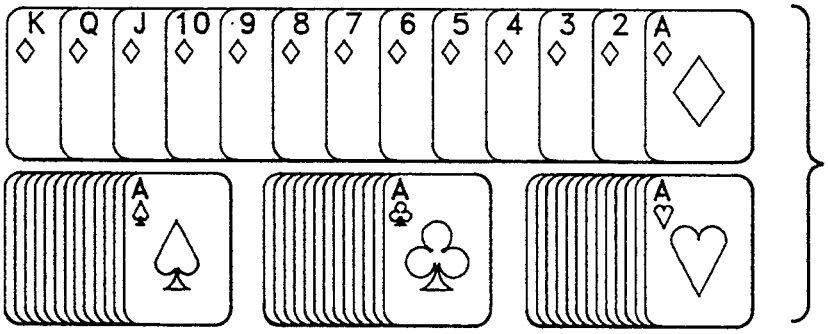
FIG. 2b

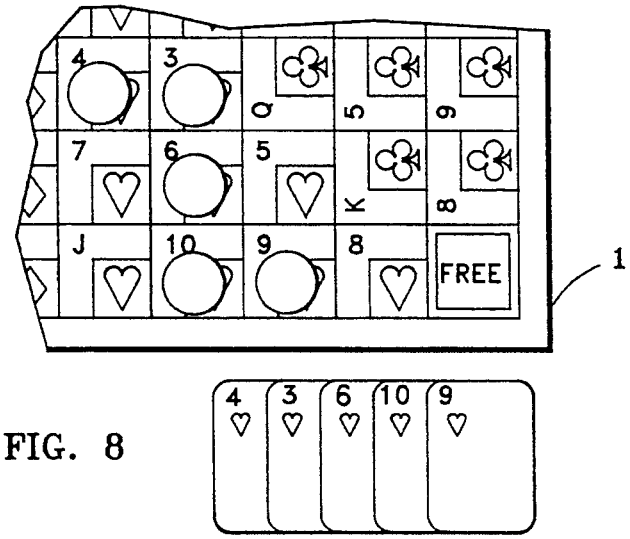
FIG. 8
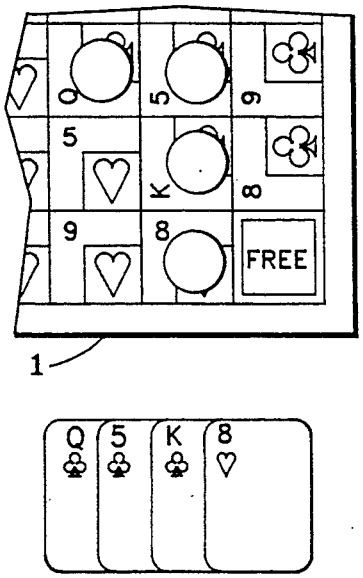
FIG. 10
FIG. 9
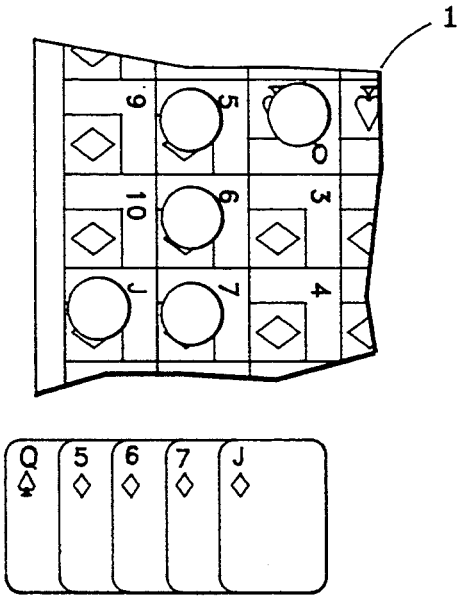
FIG. 11
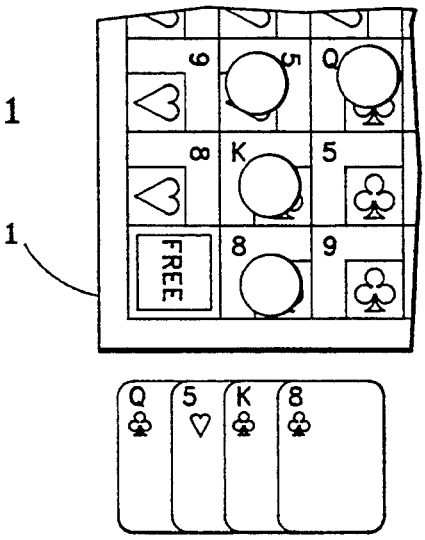

METHOD OF PLAYING A BOARD GAME UTLIZING PLAYING CARDS AND TOKENS

CROSS REFERENCES TO PRIOR APPLICATION

There is a related application involving the instant invention. It is Ser. No. 08/148,623 with a filing date of Nov. 8, 1993 that has been voluntarily abandoned by your inventor.

FEDERALLY SPONSORED RESEARCH AND DEVELOPMENT

There is no federally sponsored research and development involving the instant invention.

BACKGROUND OF THE INVENTION

1. Field of the Invention

The present invention relates to board games and more particularly those involving use of playing cards and tokens such as poker chips or pegs for placement on the game's playing board.

2. Prior Art Informational Statement

Certain devices have been patented within the broad field encompassing the instant invention, to wit:

| | Inventor | Invention | Patent No. | Date |
|---|---|---|---|---|
| 1. | Cobianchi | An Improved Pack of Playing Cards for the Game of Canasta | 700,270 | 11/25/53 |
| 2. | UK Patent Application Holdway/Champion | Line Building Game | 2 013 505 | 8/15/79 |
| 3. | Hass | Foldable Game Board and Method of Making the Same | 4,964,643 | 10/23/90 |
| 4. | Froehlig | Laminated Game Board | 3,346,259 | 10/10/67 |
| 5. | W. W. Lapham | Game Apparatus | 509,316 | 11/21/83 |
| 6. | M. S. Mayer et al | Game Apparatus | 2,105,837 | 2/27/36 |
| 7. | T. Louie | Game Board Having Concentric Closed Paths Connected By Linear Paths Intersecting at Center | 3,190,655 | 6/22/65 |
| 8. | A. A. Dean | Deck of Playing Cards | 63,287 | 11/20/23 |
| 9. | Christman | Card Game Apparatus and Method | 4,955,619 | 9/11/90 |
| 10. | Willson, Jr., et al | Sequence Board Game | 5,029,871 | 7/9/91 |

Publication: Cross Bingo Poker, Spencers Inc., Dade City, Florida 33525, 1992

Publication: Cross Bingo Poker, Spencers Inc., Dade City, Fla. 33525, 1992

However, none of these devices discloses the protocol whereby playing cards are dealt to players, and turned over, calling for tokens such as poker chips or pegs to be placed on or in a board space corresponding to the card just drawn in such a manner that victory in the game requires a set number of such chips or pegs of a given player being placed in on a requisite number of successive board spaces so as to form on the board a shape in the form of a letter Z or the reverse of a letter Z providing further that an opponent's chips can be removed by a player from the board and replace with then removing player's chips to prevent such opponent from completing such shapes before the removing player completes his/her own letter Z or reverse letter Z as the case may be.

A SUMMARY OF THE INVENTION

1. A Description of the Invention

The instant invention is a new and unique board game utilizing playing cards and chips that is very entertaining and easy to learn. As such, the instant invention provides all of the positive features of other board games in the related art but none of what could be terms the negative features thereof such as intricacy of and prolonged length of play.

With resort to the drawings, it will be noted that a novel foldable playing board that is both aesthetically pleasing to view and durable is utilized in conjunction with two decks of playing cards, 52 cards to a deck without jokers and a number of tokens such as conventional poker chips of varying colors. The game's playing board is rectangular in shape and divided up into two symmetrical halves. Each half of the board which is foldable and very durable is made up of a series of adjacent rectangular spaces except as respects the four corner spaces whereby each space bears an indication similar to the faces of the playing card components of the game. The four corner spaces which are also rectangular are designated as free spaces. When played, the game requires that eight cards be dealt to each of two players of the game. If there are more than two players, then, each player is dealt six cards. The rest of the cards are placed in a so-called draw pile. The first player lays one of the cards in his/her hand face up next to the board near that player to thus commence formation of a discard pile. The first player then places one of his/her tokens on the rectangular space on the board corresponding to the card he/she would have just lain down. That player then draws a card from the draw pile of cards to replace the card just lain down from his/her hand. The second player then proceeds just as did the first, then so does a third player, etc., and the process is simply repeated player by player. Each player tries to lay down tokens on five rectangular spaces or on four such spaces together with a corner free space so as to form on the board a shape with tokens in the form of a letter, Z or the reverse of the letter, Z. Opponents seek to thwart their adversarys' efforts in such regards by placing tokens adjacent to their adversarys' tokens so as to prevent any such adversary from getting spaces covered in one, three, one fashion to form thereupon a letter Z or the reverse of the letter Z. If a player lays down a black ace from his/her hand, then, he/she can remove any one of any opponent's tokens from the board except a token from a completed Z or completed reverse Z. The removed token is then replaced in the same turn by the removing player with one of the removing player's tokens to thereby, where possible, block an opponent's efforts to complete a Z or reverse Z. If a player lays down a red ace from his/her hand, then he/she can place one of his/her tokens anywhere he/she wishes on the board to for instance complete thereupon a letter Z or complete thereupon the reverse of a letter Z or to block, where possible, an opponent's effort to complete a Z or reverse Z. Drawing from the discard pile prior to discarding is another option. Drawing or discarding first could be decided upon at the beginning of a given game and would govern play throughout completion of that game.

The object of the game is to be the first player to offensively accomplish formation of a shape with one's own tokens on the rectangular spaces on the game board in one, three, one fashion, in the form of a letter Z or the reverse of the letter Z and finally then to accomplish formation of a second shape, with further play, of one's own tokens on the board spaces in one, three, one fashion, in the form of a letter Z or the reverse of the letter Z such that however the two formed shapes are the opposite of one another. While seeking to accomplish such an outcome, a player will remain ever watchful for opportunities to thwart his/her opponents' efforts in such regards by way of, for example, where possible and appropriate, playing a black ace to knock off one of one such opponent's tokens from one of his/her Z's or reverse Z's in evolution and then replacing such knocked off token with one of the removing player's tokens or, for example, playing a red ace thereby permitting that player to put one of his/her tokens onto the board so as to in either event prevent an opponent from further building a letter Z or reverse letter Z on the board. A completed Z or reverse Z of any given opponent however cannot be disturbed. If after all cards have been drawn from the draw pile, no player has yet to form both a letter Z and a reverse letter Z, then, all discards are shuffled together and a new draw pile is created and the game continues until a player wins by being the first player to form a letter Z and then the reverse of the letter Z or the reverse of the letter Z and then the letter Z on the board with his/her tokens.

2. The Object of the Invention

The essential object of the instant invention is to provide fun and entertainment to one or more players without the need to contemplate or grapple with intricate, complicated rules of play. The instant invention in respect of providing same is, respectfully submitted, a new, useful and unique means of providing users with a truly relaxing and enjoyable means of healthful, stress-free recreation.

A DESCRIPTION OF THE DRAWINGS

FIG. 1 is a top view of the game board component of the invention.

FIG. 2*a* is a top view of the first one of the two conventional fifty-two playing card deck components of the invention.

FIG. 2*b* is a top view of the second one of the two conventional fifty-two playing card deck components of the invention.

Figure 7:
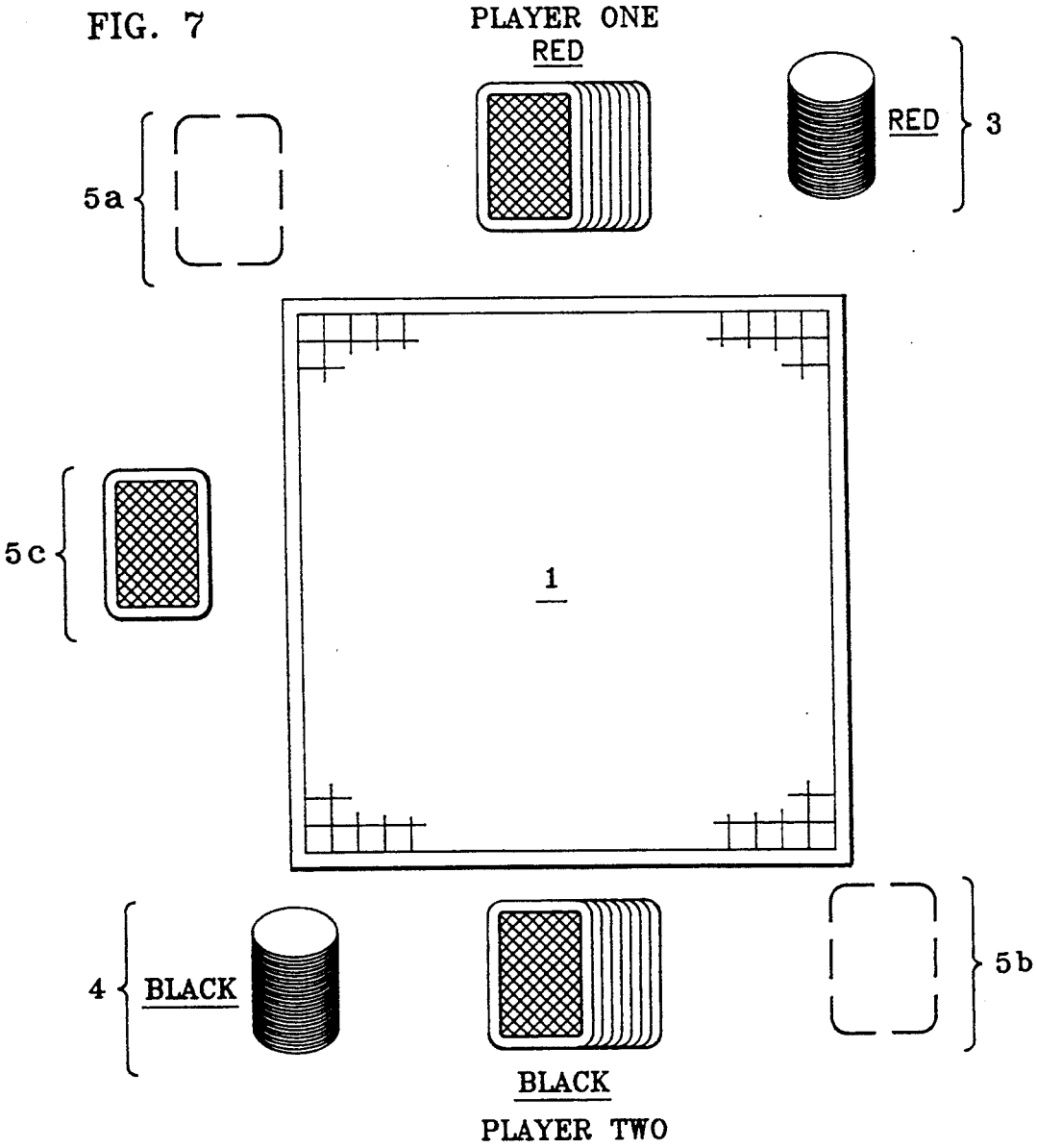

FIG. 7 is a top view of: two dotted line depictions of two discard piles consisting of cards from each of the, here only two, players hands that are discarded during their respective turns of play together with two hands of eight cards, two stacks of token components, the inventor's game board and a draw pile consisting of cards from the abovesaid two deck components not dealt initially to the players.

FIG. 8 is a top view depicting one illustrative run of five cards and five chip tokens on corresponding rectangular board spaces in the shape of a letter, Z on the invention's game board.

FIG. 9 is a top view depicting one illustrative run of five cards and five chip tokens on a on corresponding rectangular board spaces in the shape of a reverse letter, Z on the invention's game board.

FIG. 10 is a top view depicting another such letter Z as shown in FIG. 8 only utilizing a corner free space in conjunction with four chip tokens on four rectangular board spaces connected to one another with one connected to the corner free space on the invention's game board to form thereon the shape of the letter Z.

FIG. 11 is a top view depicting another such reverse letter Z as shown in FIG. 9 only utilizing a corner free space in conjunction with four chip tokens on four rectangular board spaces connected to one another with one connected to the corner free space on the invention's game board to form thereon the shape of the reverse letter Z.

Figure 12:
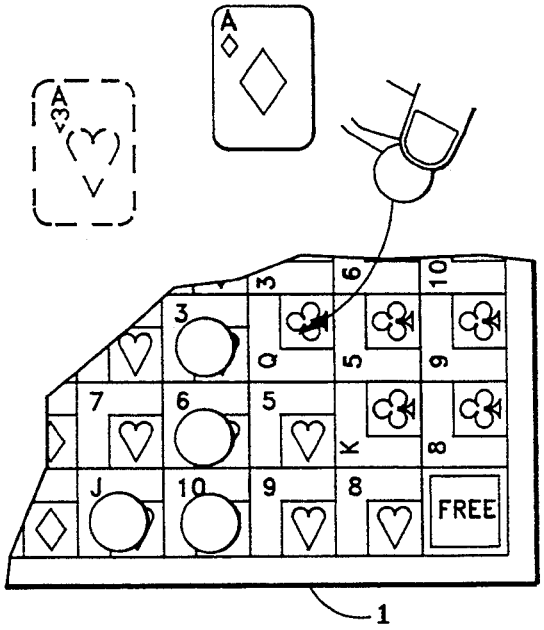

FIG. 12 depicts the commencement of the playing of a chip token anywhere on the game board one chooses when one plays a red ace.

Figure 13:
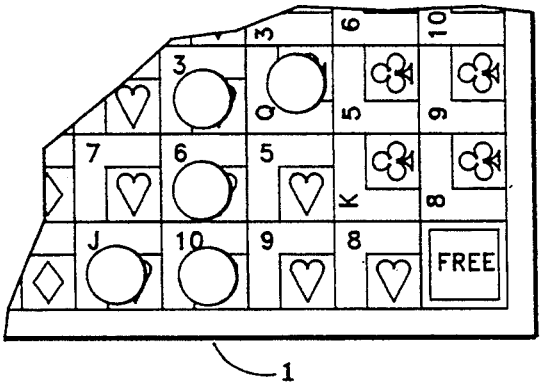

FIG. 13 depicts the placement of the chip token to be played as per FIG. 12 on the rectangular space on the game board ultimately selected by the player of a red ace.

Figure 14:
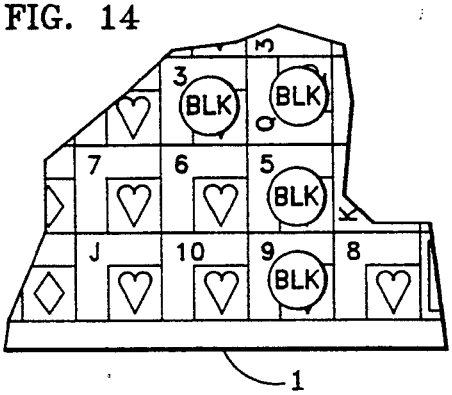

FIG. 14 depicts a letter Z in evolution of four black chip tokens on four rectangular spaces on the game board.

Figure 15:
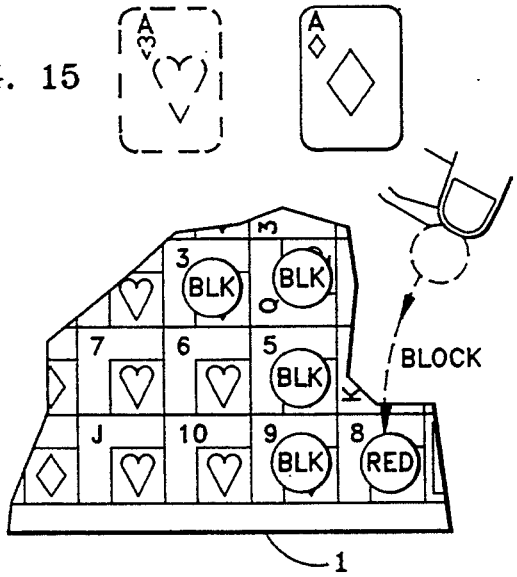

FIG. 15 depicts the interruption of formation of an opponent's letter Z in evolution shown in FIG. 14 by way of playing a red ace and then placing a red chip tokens on one end of the run.

Figure 16:
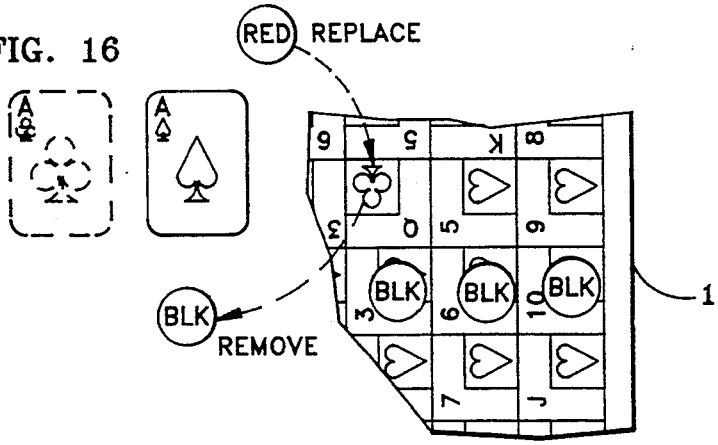

FIG. 16 depicts a letter Z in evolution shown in FIG. 14 interrupted by way of removal of one of the chip tokens in such a run in evolution by way of the playing of a black ace and the replacement of same in the same turn with a chip token belonging to the removing player having played a black ace.

A DESCRIPTION OF THE PREFERRED EMBODIMENT

Figure 3:
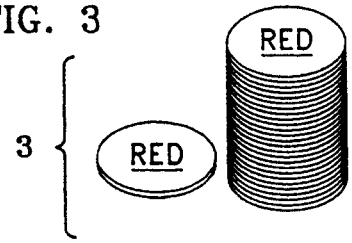
FIG. 3 is a perspective view of the stack of red chips which is one of the token components of the invention.
Figure 4:
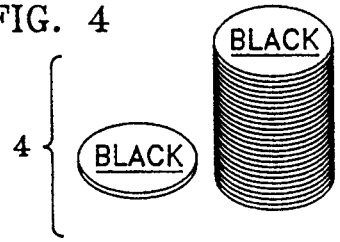
FIG. 4 is a perspective view of the stack of black chips which is one of the token component of the invention.
Figure 5:
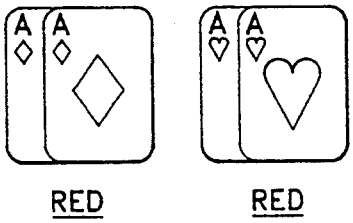
FIG. 5 is a top view of the two red aces of diamonds and the two red aces of hearts from the abovesaid two playing card components of the invention.
Figure 6:
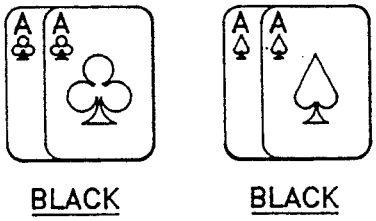
FIG. 6 is a top view of the two black aces of clubs and the two black aces of spades from the abovesaid two playing card components of the invention.

FIG. 1 shows game board component 1 of the invention. The board component 1 is rectangular in shape and is made up of 100 equal rectangular spaces. There are four so-called free spaces and ninety-six other spaces that each correspond to exemplar elements of the whole of each of two complete decks of playing cards except the eight aces, four aces per deck. Hence, there are two spaces for, for example, both kings of hearts, one from each deck, both two of clubs, one from each deck and so forth. The positioning of each such one of these ninety-six rectangular spaces shown in FIG. 1 corresponding to a given card from either of the two decks is not unique. The positioning of the four free spaces need not necessarily be in the four corners of game board component 1 although, in best mode, the four free spaces are at the respective four corners of game board component 1. Player one is dealt eight cards from deck components 2a and 2b shown in FIG. 2a and FIG. 2b which deck components 2a and 2b contain fifty-two playing cards each, of which are conventional full decks of playing cards absent the jokers. Player two is dealt eight cards from deck components, 2a and 2b. Player one is supplied with a stack of red colored circular shaped chips, stack components 3 and player two is supplied with a stack of black colored circular shaped chips, stack component 4. The game is played with reference to FIG. 7. Player one lays down one of his/her eight cards previously dealt to him/her from a shuffled combination of the one hundred and four cards in deck components 2a and 2b, to wit: all of the cards in both deck components less the jokers in each and does so by placing the card on a first discard pile 5a. Player one then places one of his/her red chips from stack component 3 on the rectangular space on board component 1 that corresponds to the card just lain down by player one. Player one then draws a card to replace the one lain down which replacement card is drawn from draw pile 5c consisting of all of the cards from deck components 2a and 2b not initially dealt to players, one and two. Player two then lays down one of his/her eight cards previously dealt to him/her from the above-mentioned shuffled combination of the one hundred and four cards in deck components 2a and 2b and does so by placing the card on a second discard pile 5b. Player two then places one of the chips from stack component 4 on the rectangular space on board component 1 that corresponds to the card just lain down by player two. Player two then draws a card to replace the one lain down which replacement card is drawn from draw pile 5c. Player one then repeats the operation just performed by that player as then does player two right thereafter and so forth. It would be permissible to allow for a draw of a card from first discard pile 5a before the playing of a card by a player from his/her hand. In this way, a player could discard either the drawn card or a card previously dealt to the player. Drawing before discarding or discarding before drawing would be a rule decided upon at the outset of the playing of the game and would be binding on all players thought the whole of the game. Each player strives to be the first of the players to accomplish the rendering of shapes on the board with chips, one in the form of a five space, one-three-one letter Z and then another one in the form of a five space, one-three-one reverse letter Z or a first one in the shape of a reverse letter Z followed by one with a letter Z shape. Two shapes in the form a letter Z or in the form of a reverse letter Z will not constitute a winning of the game. Only one and then the other, its opposite will constitute upon completion of the same, by any player, a win. The four free spaces on the board can be utilized where appropriate to help form a shape of a letter Z or a shape of a reverse letter. If and when a player forms with that player's chips a shape on the board of a letter Z or a reverse letter Z, then that player has accomplished a "Zoom" on the board. If and when that player subsequently forms on the board the reverse of the initial shape, then that player so accomplishing the same will have accomplished a "Zoomeron" and will be thereby deemed the winner of the game. With further resort to the drawings, FIG. 8 illustrates the formation of a shape in the form of a letter Z on the board. FIG. 9 illustrates the formation of a reverse letter Z on the board. FIG. 10 illustrates the formation of a shape in the form of a letter Z utilizing one of the board's four face corner spaces to do so. FIG. 11 illustrates the formation of a shape in the form of a reverse letter Z utilizing one of the board's four free corner spaces to do so. FIG. 5 shows the two red aces of diamonds and two red aces of hearts from deck components 2a and 2b. FIG. 12 and FIG. 13 show how when a player lays down one of these cards either initially dealt to that player or later drawn by that player from draw pile 5c as shown in FIG. 7 during play, then, that player may place a chip anywhere on the board to either add to a letter Z or reverse letter Z shape of that player in evolution or begin formation of the shape of a letter Z or reverse letter Z or instead to interfere with the formation of an opponent's letter Z or reverse letter Z in evolution. FIG. 15 shows interruption of a player's formation of a letter Z in evolution by virtue of an opponents's utilization of a played red ace as described above. A red ace cannot however be utilized to disturb another player's completed letter Z or completed reverse letter Z. FIG. 6 shows the two black aces of clubs and two black aces of spades from deck components 2a and 2b. FIG. 14 in conjunction with FIG. 16 shows how when a player lays down one of these four cards shown in FIG. 6 either initially dealt to him/her or subsequently drawn by that player from draw pile 5c as shown in FIG. 7 during play, then, that player may remove any one of the chips of his/her opponent from board component 1 to thus interfere with his/her opponent's building a letter Z or reverse letter Z in evolution. FIG. 14 shows a player with black chips close to forming a letter Z. FIG. 16 shows how a player using red chips when laying down a black ace is then able to remove one of the black chip player's chips from the black chip player's letter Z in evolution as seen in FIG. 14 to thus thwart the black chip player's efforts to form a letter Z by then replacing in the same turn the removed black chip with one of the removing player's red chips. A black ace cannot however be utilized to interfere with a completed letter Z or reverse letter Z. Finally, if, after all cards in the draw pile are played and no player has yet won because no player has yet formed on the board both a Z and a reverse Z, then, all discards are shuffled and put into a new draw pile and the game continues with, if need be, the formation of still newer draw piles until, at last, somebody finally wins. However, no player can place one of his/her chips on any rectangular space occupied by another player's chip unless that other player's chip has first been removed by a player's resort to the playing of a black ace. In this respect if a player draws a card from a new draw pile for which there is no uncovered rectangular space, then, that player may redraw from the new draw pile until that player draws a card for which there is an uncovered space on the board. As can be noted from the foregoing, a discarding player with a black ace in his/her hand can in any of his/her turns lay down that black ace to thereby thwart an opponent's formation of a Z or a reverse Z by way of removing from an opponent's Z in evolution on the board, one of that opponent's component tokens and replacing it in the same turn with one of the discarding player's tokens. When this done, then, the opponent is forced to being anew to form another Z or reverse Z, as the case may be, somewhere else on the board. Strategically speaking, it is always wise for a player once he/she draws a black ace to just keep it in his/her hand until the game has progressed to the point where at last an opponent is close to forming a necessary Z or reverse Z as the case may be. For example, it would be a waste of a very valuable resource, to wit, a black ace for a player with a black ace in his/her hand to play it early in the game before an opponent was close to forming a Z or reverse Z. If, on the other hand, later in the game, an opponent were found to be close to forming a complete Z or reverse Z with his/her tokens, and, the player all of a sudden luckily drew a black ace, then that player could right then discard the black ace, remove one of the opponent's tokens from the opponent's almost completed Z or reverse Z, replace the removed token with one of the player's tokens and in so doing force the opponent to begin Z or reverse Z formation as the case may be anew elsewhere on the board as noted previously.

It should be noted that there are a number of variations to the above-described best mode of the instant invention and these are meant to be encompassed by the ensuing claims. For example, in lieu of chips, pegs could be used for placement in holes centered in each of the rectangular spaces on the invention's game board component 1. This mode of the game would be handy for people choosing to play the same while riding as passengers in a moving vehicle. Moreover, in lieu of decks of playing cards as described above, cards could be used depicting instead: thirteen types of birds, all different; thirteen types of reptiles, all different; thirteen types of mammals; all different and thirteen types of fish, all different with corresponding rectangular shapes on board component 1. For example, there could be two board spaces corresponding to a robin, two board spaces corresponding to a goldfish with two robins in the two deck components, two goldfish in the two deck components and so forth. Finally, the game can be played by two or more players. If the game is played with more than two players, then, each player is dealt six cards initially instead of eight. A game would then consist of not only a stack of red chips or pegs and black chips or pegs but also blue chips or pegs, green chips or pegs, orange chips or pegs and so forth.

In closing, the same when played as noted above, is respectfully submitted, unquestionably a way to genuinely relax and have a thoroughly enjoyable and good time.

What is claimed is:

1. A method for playing a board game comprising the steps of:

a) providing a rectangular game board;

b) division of the face of said game board into one hundred rectangular spaces all of the same size area;

c) providing a first deck of fifty two different playing cards without jokers;

d) providing a second deck of fifty two different playing cards without jokers one each of which said playing cards in said second deck is exactly identical to each one of said playing cards in said first deck;

e) providing that ninety-six of said one hundred rectangular spaces correspond with indicia imprinted thereupon to each of the playing cards in said first deck and said second deck except the aces;

f) providing that four of said one hundred rectangular spaces correspond with indicia imprinted thereupon to each of four free spaces;

g) providing a plurality of distinct sets of game tokens for occupation of said rectangular spaces;

h) shuffling said first deck of cards and said second deck of cards, then combining them all with one another;

i) dealing a portion of said shuffled and combined decks evenly amongst players of the game;

j) placing the undealt portion of said shuffled and combined cards into a draw pile;

k) requiring that a first discard one of the said dealt portion of cards in said first player's hand and effectuate occupation of the one of said rectangular spaces that correspond to said discarded card with one of said tokens within the one of said distinct sets of tokens previously assigned for use by said player;

l) requiring that said first player then draw a card from the top of the said undealt portion of said shuffled and combined cards in said draw pile;

m) requiring that each of the other players of the game in each said other player's respective turn of play, play by discarding one of the said dealt cards in said other player's hands and effectuate occupation respectively of the one of said rectangular spaces that corresponds to said other player's discarded card with each of said other player's opponents to do so as well with respect to one of the said tokens within the said distinct sets of tokens previously assigned for use by each of said players opponents respectively and further requiring that each said other player in each said other player's turn of play then draw a card from the top of said undealt portion of said shuffled and combined cards in said draw pile;

n) providing that discarding of a red ace by said first player or any said other player shall permit said discarding player to place one of said discarding player's said tokens found in said player's said set of tokens on any one of said rectangular spaces said discarding player wishes to cover;

o) providing that any of said players beginning with the first play of the first of said other players playing directly after said first player and thereafter in turn said first player may, discard a black ace that shall permit that discarding player to remove any opponent's token from the one of said rectangular spaces where that opponent's said token is to be found and require said discarding player to then in the same turn replace said removed token with a token of said discarding player on said one of said rectangular spaces;

p) proceeding to play until said first player or one of said other players will have been the first to cover five of said imprinted rectangular spaces or four of said imprinted rectangular spaces and one of said free spaces in order to form on said game board a first shape in the form of the letter Z and then cover five more of said imprinted rectangular spaces or four more of said imprinted rectangular spaces and one more of said free spaces to form on said same board a second shape in the form of a reverse letter Z or to form in such manner instead said second shape in the form of a reverse letter Z and then in such manner said first shape in the form of the letter Z and thereby win the game;

q) providing that, if after all cards in said draw pile have been drawn by all players of the game during the course of play and if, in such event, no player has been able by then to so form said first shape in the form of the letter Z and then so form said second shape in the form of a reverse letter Z or to so form said second shape in the form of reverse letter and then so form said first shape in the form of the letter Z, then all cards previously discarded by all players are gathered up, shuffled and combined into a new draw pile with play then continuing, and, if need be, new discards further regathered, shuffled and combined into newer draw piles with play still continuing until, at last, a player wins the game;

r) providing further that no player may place a token on any said rectangular board space occupied by any other player's token unless said other player's said token will have first been removed therefrom by virtue of the playing of a black ace;

s) providing finally that if said first player or any said other player draws a card from any said new draw pile for which there is no unoccupied corresponding said rectangular board space, that then said first player or any other said player may discard said drawn card and redraw from said new draw pile until drawing a card for and with respect to which there is a corresponding unoccupied said rectangular board space.

2. A Method for playing a board game comprising the steps of:

a) providing a rectangular game board;

b) division of the face of said game board into one hundred rectangular spaces all of the same size area;

c) providing a first deck of fifty two different playing cards without jokers;

d) providing a second deck of fifty two different playing cards without jokers one each of which said playing cards in said second deck is exactly identical to each one of said playing cards in said first deck;

e) providing that ninety-six of said one hundred rectangular spaces correspond with indicia imprinted thereupon to each of the playing cards in said first deck and said second deck except the aces;

f) providing that four of said one hundred rectangular spaces correspondence with indicia imprinted thereupon to each of four free spaces;

g) providing a plurality of distinct sets of game tokens for occupation of said rectangular spaces;

h) shuffling said first deck of cards and said second deck of cards, then combining them all with one another;

i) dealing a portion of said shuffled and combined decks evenly amongst players of the game;

j) placing the undealt portion of said shuffled and combined cards into a draw pile;

k) requiring that a first player then draw a card from the top of the said undealt portion of said shuffled and combined cards in said draw pile;

l) requiring that said first player then discard either said drawn card or one of the said dealt portion of cards in said first player's hand and effectuate occupation of the one of said rectangular spaces that correspond to said discarded card with one of said tokens within the one of said distinct sets of tokens previously assigned for use by said player;

m) requiring that each of the other players of the game in said other player's respective turn of play, draw a card from the top of the said undealt portion of said shuffled and combined cards in said draw pile and then play by either discarding said drawn card or one of the said dealt cards in said other player's hands and effectuate occupation respectively of the one of said rectangular spaces that corresponds to said other player's discarded card with each of said other player's opponents to do so as well with respect to one of the said tokens within the said distinct sets of tokens previously assigned for use by each of said players opponents respectively, n) providing that discarding of a red ace by said first player or any said other player shall permit said discarding player to place one of said discarding player's said tokens found in said player's said set of tokens on any one of said rectangular spaces said discarding player wishes to cover;

o) providing that any of said players beginning with the first play of the first of said other players playing directly after said first player and thereafter in turn said first player may, discard a black ace that shall permit that discarding player to remove any opponent's token from the one of said rectangular spaces where that opponent's said token is to be found and require said discarding player to then in the same turn replace said removed token with a token of said discarding player on said one of said rectangular spaces;

p) proceeding to play until said first player or one of said other players will have been the first to cover five of said imprinted rectangular spaces or found of said imprinted rectangular spaces and one of said free spaces in order to form on said game board a first shape in the form of the letter Z and then cover five more of said imprinted rectangular spaces or four more of said imprinted rectangular spaces and one more of said free spaces to form on said same board a second shape in the form of a reverse letter Z or to form in such manner instead said second shape in the form of a reverse letter Z and then in such manner said first shape in the form of the letter Z and thereby win the game;

q) providing that, if after all cards in said draw pile have been drawn by all players of the game during the course of play and if, in such event, no player has been able by then to so form said first shape in the form of the letter Z and then so form said second shape in the form of a reverse letter Z or to so form said second shape in the form of reverse letter and then so form said first shape in the form of the letter Z, then all cards previously discarded by all players are gathered up, shuffled and combined into a new draw pile with play then continuing, and, if need be, new discards further regathered, shuffled and combined into newer draw piles with play still continuing until, at last, a player wins the game;

r) providing further that no player may place a token on any said rectangular board space occupied by any other player's token unless said other player's said token will have first been removed therefrom by virtue of the playing of a black ace;

s) providing finally that if said first player or any said other player draws a card from any said new draw pile for which there is no unoccupied corresponding said rectangular board space, that then said first player or any other said player may discard said drawn card and redraw from said new draw pile until drawing a card for and with respect to which there is a corresponding unoccupied said rectangular board space.

* * * * *